United States Patent [19]

Blakeman et al.

[11] Patent Number: 4,753,340

[45] Date of Patent: Jun. 28, 1988

[54] DEVICE FOR STORING AND CARRYING MEDICINE AND OTHER ITEMS

[76] Inventors: Jerry Blakeman, 302 Sangaree Rd.; Donald H. Caldwell, 5 Fairway Ct.; William W. King, Jr., 222 Gervais, all of Waterboro, S.C. 29488

[21] Appl. No.: 819,909

[22] Filed: Jan. 17, 1986

[51] Int. Cl.[4] ..... B65D 23/12

[52] U.S. Cl. ..... 206/44.11; 206/528; 206/538; 206/461; 206/45.14; 211/78; 211/70; 211/131

[58] Field of Search ..... 211/78, 70, 131; 206/528, 461, 838, 373, 44 R, 44.11, 44.14

[56] References Cited

U.S. PATENT DOCUMENTS

| | | | |
|---|---|---|---|
| 391,186 | 10/1888 | Parker | 211/70 |
| 1,449,065 | 3/1923 | Smith | 211/78 |
| 2,131,807 | 10/1938 | Jerum | 211/70 |
| 2,883,063 | 4/1959 | Baren | 211/70 |
| 3,848,943 | 11/1954 | Geesaman et al. | 206/373 |
| 3,917,072 | 11/1975 | Bleed | 211/78 |
| 4,305,511 | 12/1981 | Denholtz | 211/70 |
| 4,339,164 | 7/1982 | Spevak | 206/373 |
| 4,453,326 | 6/1984 | Hoffman et al. | 211/78 |
| 4,512,511 | 4/1985 | Zimmermann | 206/44 R |

*Primary Examiner*—Joseph Man-Fu Moy
*Attorney, Agent, or Firm*—W. Alex Dallis, Jr.

[57] ABSTRACT

A storage device for medicine, comprises a turntable with an outer rim and a circular base sitting on it. Such base includes a plurality of vertical planar members extend radially and fasteners on such members to hold original containers of the medicine.

31 Claims, 2 Drawing Sheets

DEVICE FOR STORING AND CARRYING MEDICINE AND OTHER ITEMS

FIELD OF THE INVENTION

The present invention relates to a device for storing and carrying medicine and other items allowing for removable fastening of medicine and other items in original containers to the device, particularly by means of strips of male and female hook and eye cloth fastener or two-sided adhesive, and providing space for instructions as to use of medicine and other items so attached.

DESCRIPTION OF PRIOR ART

From the teachings of U.S. Pat. No. 3,693,807, a rotary-type display stand is known for display of articles upon racks which may be rotated about a vertical axis.

Additional rotary-type display stands with slight modifications are known from the teachings of U.S. Pat. Nos. 3,695,455, 3,855,943, and 3,917,072. Articles are usually attached to such display stands by use of perforated board, hooks and arms. This has the disadvantage that items to be attached to the display stand must be of a form attachable through such means or must be contained within a package of a form attachable through such means.

From the teachings of U.S. Pat. No. 3,917,072 a revolvable display rack is known which an be disassembled, folded and packed in a relatively flat package for transportation. This has the disadvantage of requiring removable of the articles attached to the rack and disassembly of the rack prior to transport.

From the teachings of U.S. Pat. No. 4,301,205, a device for fastening objects on a flat support member is known utilizing adhesive coating that does not loose its adhesiveness despite frequent removal of objects therefrom. This has the disadvantage that the adhesive coating adheres to all objects coming into contact therewith and not just those objects for which attachment is intended.

There is not storage device upon a rotatable base for the storage of medicine and other items known which is portable, provides for removable fastening of the original containers of medicine and other items and provides for display of dosage and dispensing or use instructions.

It is quite frequently the case among aged patients or those convalescing from serious illness that substantial number of different medicines with different requirements for dispensing are prescribed. Adherence to the proper dispensing requirements for each of these medicines is imperative to avoid deleterious side effects and to insure rapid recovery. Often elderly patients tend to place medicine in drawers, paper bags, cabinets and other locations scattered throughout their residence with the result that essential medicine may be forgotten or misplaced. Even if medicine is stored by the patient in a central location, it is often difficult for the patient to remember which medications must be taken at which particular times and it may be difficult to read the dispensing instructions which are inevitably typed in small print upon the containers of the medicine themselves. In addition, each time a patient is examined by a physician it is necessary for the physician to make an assessment as to which medicines are being administered in order to determine what additional medicine or what alterations in the present medication, if any, is necessary. Finally, storage of medicine in its original containers guarantees that the safety resulting from the safety caps provided with such containers is maintained. To the extent that these medicines can be stored in the original containers in an organized fashion in a storage device which displays the dispensing instructions for each such medicinal item and which may be easily transported, for refilling of prescriptions, for review by doctors or for travel, the dangers of accidental overdose, loss, improper dispensing, erroneous prescriptions and adverse side effects can be avoided.

It is an object of the present invention to provide a device for storing medicine and other items in the original containers which may be removed from a turntable and utilized for transport of such medicine and other items and which provides a means of removably fastening the containers for such medicine and other items to such storage device and for displaying upon such storage device the instructions for dosage and dispensing of the medicine or use of other items within the containers so attached.

SUMMARY OF THE INVENTION

In accordance with the invention, the object of organized storage in original containers with dispensing or use instructions is achieved by providing a device with vertical planar members upon the bottom of which members appear placards showing the dosage and dispensing or use instructions for medicine and other items attached to such members and upon which are placed some means of fastening the containers for medicines and other items. In particular the means contemplated for fastening containers to the vertical planar numbers include a plurality of strips of male or female hook and eye cloth fastener attached to each of the vertical planar members to which may be removable fastened strips of hook and eye cloth fastener of the opposite gender which are affixed to the original containers for medicine or alternatively a plurality of strips of two-sided adhesive attached to the vertical planar members. The object of ease in transport of the medicine and other items stored within the device is achieved by provision of a handle upon the device and a cover for the device and the removable nature of the base.

DESCRIPTION OF THE PREFERRED EMBODIMENTS

Figure 1:
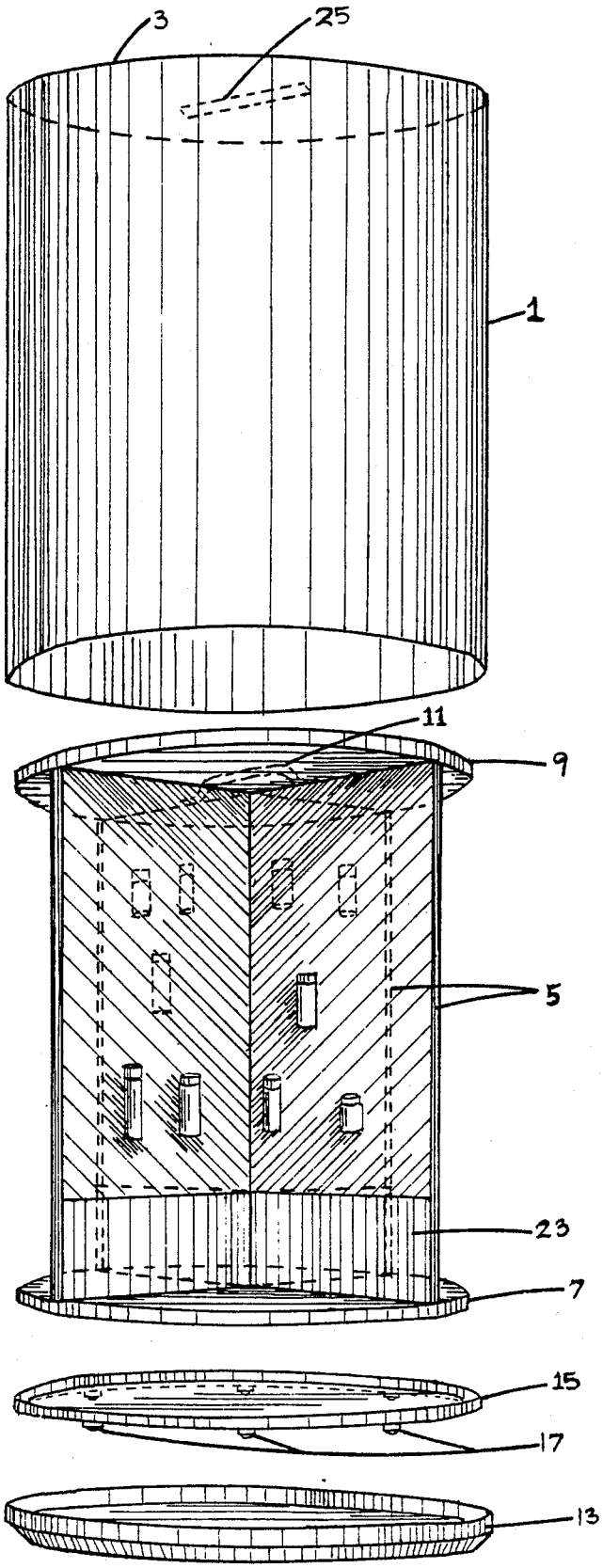
FIG. 1 shows an expanded perspective view of the entire storage devise with cover.
Figure 3:
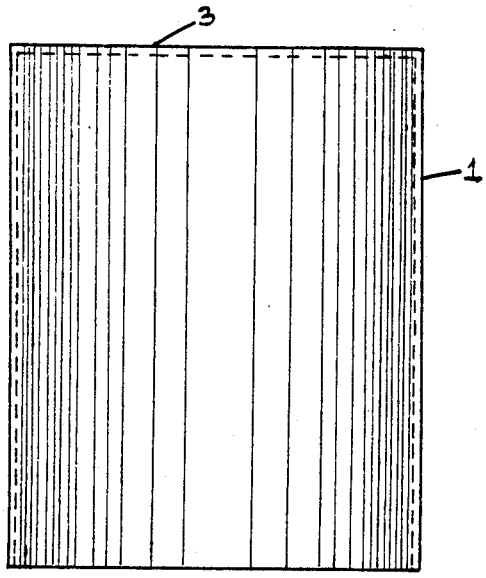
FIG. 3 shows a top view of the cover.
Figure 3:
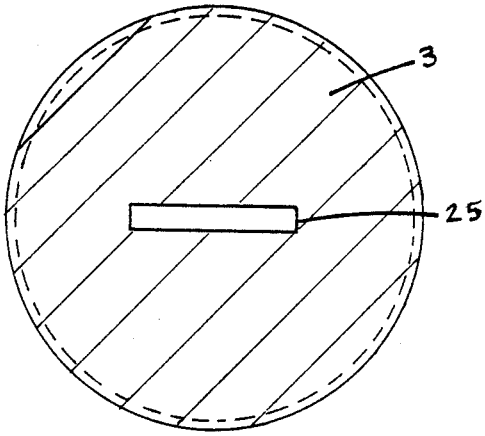
Figure 2:
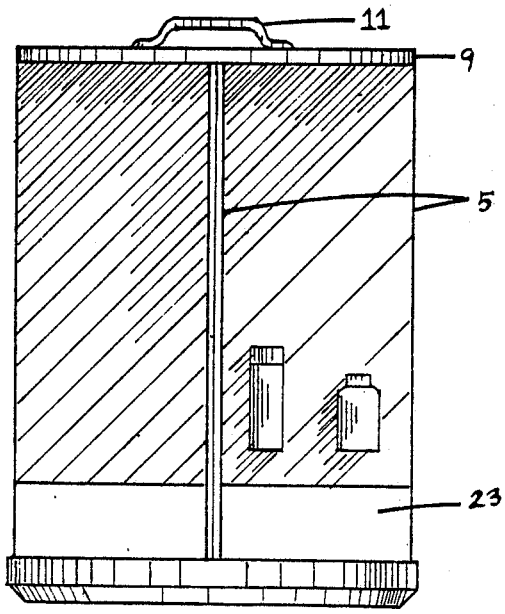
FIG. 2 shows a side view of the storage device with cover.
Figure 4:
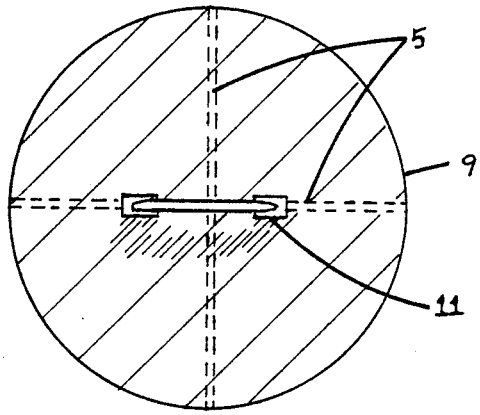
FIG. 4 shows a top view of the storage device without the cover.
Figure 5:
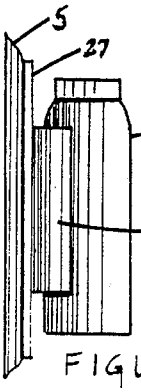
FIG. 5 shows the wall of the storage device to which is attached a container of medicine.
Figure 6:
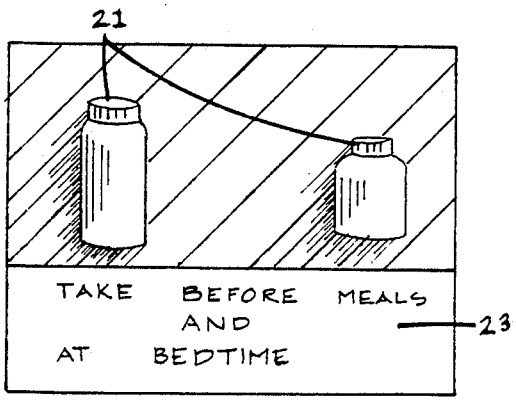
FIG. 6 shows a wall of the storage device to which are attached two containers of medicine and the placard showing dispensing instructions.
Figure 7:
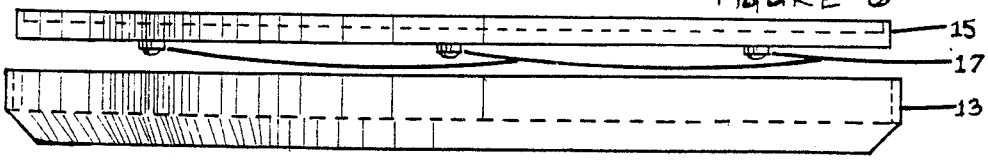
FIG. 7 shows the turntable with outer rim.

The storage device is adapted to stand on the floor, table tops, counter tops and other flat horizontal surfaces and includes a turntable with outer rim comprised of a turntable base 12, a plurality of ball bearing connections 17, herein shown six in number, mounted in angularly spaced relation about the center of the bottom of a rotatable plate 15 with rim. The storage device base 7, herein shown circular in shape, is fully detachable from the plate 15 and is of such outer diameter as to fit snugly within the rim on the plate 15. A plurality of vertical planar members 5, herein shown four in number, are rigidly and permanently secured to the storage device base 7 and the storage device top 9, herein shown circular in shape. At the bottom of each side of each vertical planar member 5 is affixed removably or permanently a dispensing or use directions placard 23. To each vertical planar member 5 is affixed a plurality of strips of male or female hook and eye cloth fastener or two-sided adhesive. If strips of hook and eye cloth fastener are affixed to the vertical planar member 5, there is affixed to each container of medicine 21 a strip of hook and eye cloth fastener of the opposite gender from the cloth comprising the strip 19 placed upon the vertical planar member 5. Upon the storage device top 9 is attached rigidly and permanently a handle 11. A cover assembly is comprised of an open-ended cylinder 1, herein shown circular in shape, with a flat plate 3, herein shown circular in shape, rigidly and permanently attached thereto. To provide for the protrusion of the handle 11 an orifice 25 is provided in the flat plate 3. While the drawings show the invention with a generally circular shape, it is possible to modify the storage device base 7 and the storage device top 9 to create a shape having any number of sides. The cover assembly would then be modified such that the open-ended cylinder 1 would be a polygonal cylinder having an equal number of sides as the storage device base 7 and the storage device top 9 and the flat plate 3 would be polygonal in shape having the same number of sides as the storage device base 7 and the storage device top 9.

We claim:

1. A storage device, which comprises:

(a) a turntable with outer rim;

(b) a circular base which has a diameter slightly smaller than the inner diameter of the outer rim of the turntable;

(c) a plurality of vertical planar members which are permanently attached to the top of the base of the bottom edge of each of the vertical planar members such that the inside edge of each of the vertical planar members is permanently joined with the inside edge of all other vertical planar members at an axis extended vertically from the center of the base and the outside edge of each of the vertical planar members is displaced radially from each of the other vertical planar members; and (d) means for fastening articles to each of the vertical planar members.

2. A storage device as recited in claim 1, further comprising a plurality of placards for providing use or dispensing instructions, at least one of which is permanently fastened to each side of each of the vertical planar members.

3. A storage device as recited in claim 1, further comprising a plurality of placards for providing use or dispensing instructions, at least one of which is removably fastened to each side of each of the vertical planar members.

4. A storage device as recited in claim 1, further comprising:

(a) a circular top plate permanently attached to the top of each of the vertical planar members such that the circular top plate is aligned with the circular base;

(b) a handle permanently affixed to the center of the top of the circular top plate; and (c) a cover comprising:

(i) an open-ended circular cylinder of sufficient inner diameter to enclose all the vertical planar members and of sufficient length to reach from the base to the top of the circular top plate; and (ii) a circular plate having an outer diameter equal to that of the open-ended circular cylinder and permanently and rigidly mounted to the top end of the open-ended circular cylinder and having an orifice of sufficient size to allow protrusion of the handle there through.

5. A storage device as recited in claim 4, wherein the vertical planar members number four and are spaced such that the outside edge of each of the vertical planar members is an equal distance from the outside edge of each of the adjacent vertical planar members and further comprising a plurality of placards for providing use or dispensing instructions, at least one of which is removably fastened to each side of each of the vertical planar members.

6. A storage device as recited in claim 4, wherein the vertical planar members number four and are spaced such that the outside edge of each of the vertical planar members is an equal distance from the outside edge of each of the adjacent vertical planar members and further comprising a plurality of placards for providing use or disposing instructions, at least one of which is permanently fastened to each side of each of the vertical planar members.

7. A storage device as recited in claim 1, in which the fastening means comprises:

(a) a plurality of strips of female hook and eye fastening tape on each of the vertical planar members; and (b) a strip of male hook and eye fastening tape on the articles to be fastened.

8. A storage device as recited in claim 7, further comprising a plurality of placards for providing use or dispensing instructions, at least one of which is removably fastened to each side of each of the vertical planar members.

9. A storage device as recited in claim 7, further comprising a plurality of placards for providing use of dispensing instructions, at least one of which is permanently fastened to each side of each of the vertical planar members.

10. A storage device as recited in claim 7, further comprising:

(a) a circular top plate permanently attached to the top of each of the vertical planar members such that the circular top plate is aligned with the circular base;

(b) a handle permanently affixed to the center of the top of the circular top plate; and (c) a cover comprising:

(i) an open-ended circular cylinder of sufficient inner diameter to enclose all the vertical planar members and of sufficient length to reach from the base to the top of the circular top plate; and (ii) a circular plate having an outer diameter equal to that of the open-ended circular cylinder and permanently and rigidly mounted to the top end of the open-ended circular cylinder and having an orifice of sufficient size to allow protrusion of the handle there through.

11. A storage device as recited in claim 10, wherein the vertical planar members number four and more spaced such that the outside edge of each of the vertical planar members is an equal distance from the outside edge of each of the adjacent vertical planar members and further comprising a plurality of placards for providing use or dispensing instructions, at least one of which is removably fastened to each side of each of the vertical planar members.

12. A storage device as recited in claim 10, wherein the vertical planar members number four and are spaced such that the outside edge of each of the vertical planar members is an equal distance from the outside edge of each of the adjacent vertical planar members and further comprising a plurality of placards for providing use or dispensing instructions, at least one of which is permanently fastened to each side of each of the vertical planar members.

13. A storage case as recited in claim 1, in which the fastening means comprises a plurality of strips of two-sided adhesive on each of the vertical planar members.

14. A storage device as recited in claim 13, further comprising a plurality of placards for providing use or dispensing instructions, at least one of which is removably fastened to each side of each of the vertical planar members.

15. A storage device as recited in claim 13, further comprising a plurality of placards for providing use or dispensing instructions, at least one of which is permanently fastened to each side of each of the vertical planar members.

16. A storage device as recited in claim 13, further comprising:

(a) a circulate top plate permanently attached to the top of each of the vertical planar members such that the circular top plate is aligned with the circular base;

(b) a handle permanently affixed to the center of the top of the circular top plate; and (c) a cover comprising:

(i) an open-ended circular cylinder of sufficient inner diameter to enclose all the vertical planar members and of sufficient length to reach from the base to the top of the circular top plate; and (ii) a circular plate having an outer diameter equal to that of the open-ended circular cylinder and permanently and rigidly mounted to the top end of the open-ended circular cylinder and having an orifice of sufficient size to allow protrusion of the handle there through.

17. A storage device as recited in claim 16, wherein the vertical planar members number four and are spaced such that the outside edge of each of the vertical planar members is an equal distance from the outside edge of each of the adjacent vertical planar members and further comprising a plurality of placards for providing use or dispensing instructions, at least one of which is removable fastened to each side of each of the vertical planar members.

18. A storage device as recited in claim 16, wherein the vertical planar members number four and are spaced such that the outside edge of each of the vertical planar members is an equal distance form the outside edge of each of the adjacent vertical planar members and further comprising a plurality of placards for providing use or dispensing instructions, at least one of which is permanently fastened to each side of each of the vertical planar members.

19. A storage device which comprises:

(a) a turntable with outer rim;

(b) a base assembly comprising:

(i) a circular plate which has a diameter slightly smaller than the inner diameter of the outer rim of the turn table and a depth slightly greater than the depth of the outer rim of the turntable; and (ii) a polygonal plate, which is permanently mounted to the top of the circular plate such that the center of the circular plate lies directly below the center of the polygonal plate.

(c) a plurality of vertical planar members which are permanently attached to the top of the base assembly at the bottom edge of each of the vertical planar members such that the inside edge of each of the vertical planar members is permanently joined with the inside edge of all other vertical planar members at an axis extended vertically from the center of the base assembly and the outside edge of each of the vertical planar members is displaced radially from each of the other vertical planar members; and (d) means for fastening articles to each of the vertical planar members.

20. A storage device as recited in claim 19, in which the fastening means comprises:

(a) a plurality of strips of male hook and eye fastening tape on each of the vertical planar members; and (b) a strip of female hook and eye fastening tape on each article to be fastened.

21. A storage device as recited in claim 20, further comprising a plurality of placards for providing use or dispensing instructions, at least one of which is removably fastened to each side of each of the vertical planar members.

22. A storage device as recited in claim 20, further comprising a plurality of placards for providing use or dispensing instructions, at least one of which is permanently fastened to each side of each of the vertical planar members.

23. A storage device as recited in claim 19, wherein the vertical planar members are equal in number to the number of sides of the polygonal plate and are spaced such that the outer edge of each of the vertical planar members is located at the juncture of two outer sides of the polygonal plate and further comprising:

(a) a top plate of the same shape as the polygonal plate permanently attached to the top of each of the vertical planar members such that the outer sides of the top plate are aligned with the outer sides of the polygonal plate;

(b) a handle permanently affixed to the center of the top of the top plate; and (c) a cover comprising:

(i) an open-ended circular cylinder having the same number of vertical sides as there are outer sides upon the polygonal plates and of sufficient inner dimensions to enclose all the vertical planar members and of sufficient length to reach from the base to the top of the top plate; and (ii) a cylinder top plate, having the same shape as the polygonal plate, having outside dimensions equal to those of the open-ended polygonal plate, having outside dimensions equal to those of the open-ended polygonal cylinder, permanently and rigidly mounted to the top end of the open-ended polygonal cylinder such that the outer sides of the cylinder top plate are aligned with the vertical sides of the open-ended polygonal cylinder, and having an orifice of sufficient size to allow protrusion of the handle there through.

24. A storage device as recited in claim 23, wherein the vertical planar members number four and further comprising a plurality of placards for providing use or dispensing instructions, at least one of which is removably fastened to each side of each of the vertical planar members.

25. A storage device as recited in claim 23, wherein the vertical planar members number four and further comprising a plurality of placards for providing use or dispensing instructions, at least one of which is permanently fastened to each side of each of the vertical planar members.

26. A storage device as recited in claim 19, in which the fastening means comprises a plurality of strips of two-sided adhesive on each of the vertical planar members.

27. A storage device as recited in claim 26, further comprising a plurality of placards for providing use or dispensing instructions, at least one of which is removably fastened to each side of each of the vertical planar members.

28. A storage device as recited in claim 26, further comprising a plurality of placards for providing use or dispensing instructions, at least one of which is permanently fastened to each side of each of the vertical planar members.

29. A storage device as recited in claim 26, wherein the vertical planar members are equal in number to the number of sides of the polygonal plate and are spaced such that the outer edge of each of the vertical planar members is located at the juncture of two outer sides of the polygonal plate and further comprising:

(a) a top plate of the same shape as the polygonal plate permanently attached to the top of each of the vertical planar members such that the outer sides of the top plate are aligned with the outer sides of the polygonal plate;

(b) a handle permanently affixed to the center of the top of the top plate; and (c) a cover comprising:

(i) an open-ended circular cylinder having the same number of vertical sides as there are outer sided upon the polygonal plates and of sufficient inner dimensions to enclose all the vertical planar members and of sufficient length to reach from the base to the top of the top plate; and (ii) a cylinder top plate, having the same shape as the polygonal plate, having outside dimensions equal to those of the open-ended polygonal cylinder, permanently and rigidly mounted to the top end of the open-ended polygonal cylinder, and having an orifice of sufficient size to allow protrusion of the handle there through.

30. A storage device as recited in claim 29, wherein the vertical planar members number four and further comprising a plurality of placards for providing use or dispensing instructions, at least one of which is removable fastened to each side of each of the vertical planar members.

31. A storage device as recited in claim 29, wherein the vertical planar members number four and further comprising a plurality of placards for providing use or dispensing instructions, at least one of which is permanently fastened to each side of each of the vertical planar members.

* * * * *